US006258012B1

(12) United States Patent
Yoshimura

(10) Patent No.: US 6,258,012 B1
(45) Date of Patent: Jul. 10, 2001

(54) FITNESS MACHINE

(76) Inventor: Shinichiro Yoshimura, 4041-6, Komuro, Inamachi, Kitaadachi-gun, Saitama, 362-0806 (JP)

( * ) Notice: Subject to any disclaimer, the term of this patent is extended or adjusted under 35 U.S.C. 154(b) by 0 days.

(21) Appl. No.: 09/398,144

(22) Filed: Sep. 17, 1999

(30) Foreign Application Priority Data

Sep. 18, 1998 (JP) ..... 10-283325

(51) Int. Cl.[7] ..... A63B 69/18
(52) U.S. Cl. ..... 482/52
(58) Field of Search ..... 482/51, 52, 53, 482/70, 72, 142, 111–113

(56) References Cited

U.S. PATENT DOCUMENTS 4,798,379 * 1/1989 Jenkins ..... 482/52
5,284,461 * 2/1994 Wilkinson et al. ..... 482/53
5,308,301 * 5/1994 Chiarello ..... 482/53
5,330,402 * 7/1994 Johnson ..... 482/62
5,435,801 * 7/1995 Hung ..... 482/52

* cited by examiner

*Primary Examiner*—Stephen R. Crow
(74) *Attorney, Agent, or Firm*—Browdy and Neimark

(57) ABSTRACT

A fitness machine to provide a wide range of workout motions to the user. The machine is comprised of a base; and a pair of foot platforms adapted to alternately make vertically reciprocating motions. There may further be provided a support which is adapted to reverse an orientation with respect to said stepping platforms between positions forwardly and rearwardly thereof. Cylinders may be provided to support the foot platforms such that a constant load resistance is given while changing their stepping stroke by means of linkage combination of a hydraulic system. The foot platforms are set at laterally inclined positions.

8 Claims, 11 Drawing Sheets

FITNESS MACHINE

BACKGROUND OF THE INVENTION

1. Technical Field of the Invention

The present invention relates to a fitness machine and particularly to a fitness machine which primarily offers a stepping exercise.

2. Prior Art

As an example of the conventional fitness machine which primarily offers a stepping exercise, there is a type as shown in FIG. 9 in which the user obtains a stepping exercise by stepping on the right and left foot platforms S alternately. Another example is a type as shown in FIG. 10, in which a hand support H is secured to the base thereof such that the user rests his or her hands thereon to support his or her weight, or there are provided a pair of such hand supports adapted to be respectively swung back and forth such that the user swings the hand supports back and forth in coordination with his or her stepping actions, thus simultaneously giving a workout effect also to the upper part of his or her body.

As shown in FIG. 11A and FIG. 11B, on the other hand, there is a conventionally proposed type, in which hydraulic cylinders C by which right and left foot platforms are supported to offer a load resistance thereto. Forwardly of said right and left platforms S, there is arranged a swinging plate R, which is adapted to rotate about a pivot Q. When one of said foot platforms S is stepped on downward, the other one of the foot platforms S is adapted to be raised in coordination therewith. Further, the adjusting knob T is adjusted to cause said pivot Q to be shifted in the arrow-marked directions such that the downward stroke Y of said stepping is adjusted.

Further, as shown in FIG. 12A, the fitness machine of this type has a problem that even the same weight (of the stepping force) can magnify a force F in pressing the cylinders C by way of the foot platforms S if the angle $\alpha$ which the hydraulic cylinders C defines is small with the result that the cylinders C give the feel of less load resistance against the stepping force P.

In this way, the mere provision of said foot platforms S as shown in FIG. 9 only causes a simple motion such as elevating and lowering of the user's body in its entirety as a result of alternately stepping on his or her right and left heels, thus giving workout effects to lower part of the body in a limited range alone. Further, the effect brought about by the machine with the hand support H is limited to the motion of the upper part of the body while the lower part thereof is left unattended to.

On the other hand, the type shown in FIG. 11 which performs adjustment of the downward stepping stroke Y of the foot platform S not only has a complicated structure but also creates a problem that if the angle $\alpha$ of the cylinder C is extended as shown in FIG. 12B, the force pressing the cylinder is reduced even if the same weight P (or the stepping force) is applied thereto, thus giving the feel of heavier resistance to the stepping. The load resistance caused in stepping onto the foot platforms S is offered by the cylinders C. If an attempt is made to make the feel of such load resistance less by manipulating the adjusting knob T, the stepping stroke Y is made less while if the feel of the load resistance is attempted to be less, a larger stepping stroke Y is needed. In this way, the adjustment of the load adjustment is difficult problem.

SUMMARY OF THE INVENTION

The present invention is made to solve the above mentioned conventional problems and its aim is to provide a fitness machine which offers an all round motion of not only the upper part of the body but also the lower part thereof to provide synergistic effects while maintaining ease of use.

In order to accomplish the above objects, the present invention essentially provides, in one aspect thereof, a fitness machine which primarily offers a stepping exercise comprising a base; and a pair of foot platforms adapted to alternately make vertically reciprocating motions; and a support mounted to said base, said support being adapted to reverse an orientation with respect to said foot platforms between positions forwardly and rearwardly of said foot platforms.

In another aspect, the present invention essentially provides a fitness machine which primarily offers a stepping exercise comprising a base; a pair of foot platforms adapted to alternately make vertically reciprocating motions; and fulcrums provided on the base side of said cylinders to support said cylinders, said fulcrum being adapted to shift positions such that said foot platforms is capable of changing a stepping stroke thereof with a constant load resistance.

In a further aspect, the present invention essentially provides a fitness machine which primarily offers a stepping exercise comprising a base; a pair of foot platforms adapted to alternately make vertically reciprocating motions; and cylinders pivotally secured to said base to provide said pair of foot platforms with a load resistance; a fluid circuit filled with an actuating fluid to provide communication between said cylinders; a control chamber provided amid said fluid circuit to regulate a capacity of said control chamber to regulate inflows of said actuating fluid into said cylinders such that said cylinders provides each foot platform with a variable stepping stroke while maintaining a constant load resistance.

In a still further aspect, the present invention essentially provides a fitness machine which primarily offers a stepping exercise comprising a base; a pair of foot platforms adapted to alternately make vertically reciprocating motions, said foot platforms being adapted to be set at laterally mutually inclined positions.

DESCRIPTION OF THE EMBODIMENTS

Hereinafter, one embodiment of the invention will be explained with reference to the attacked drawings.

Figure 1A:
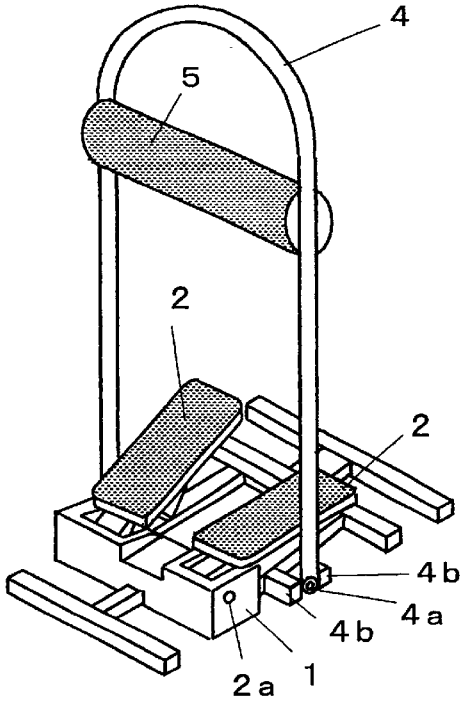
FIG. 1A is a perspective view of one embodiment of the fitness machine.
Figure 1B:
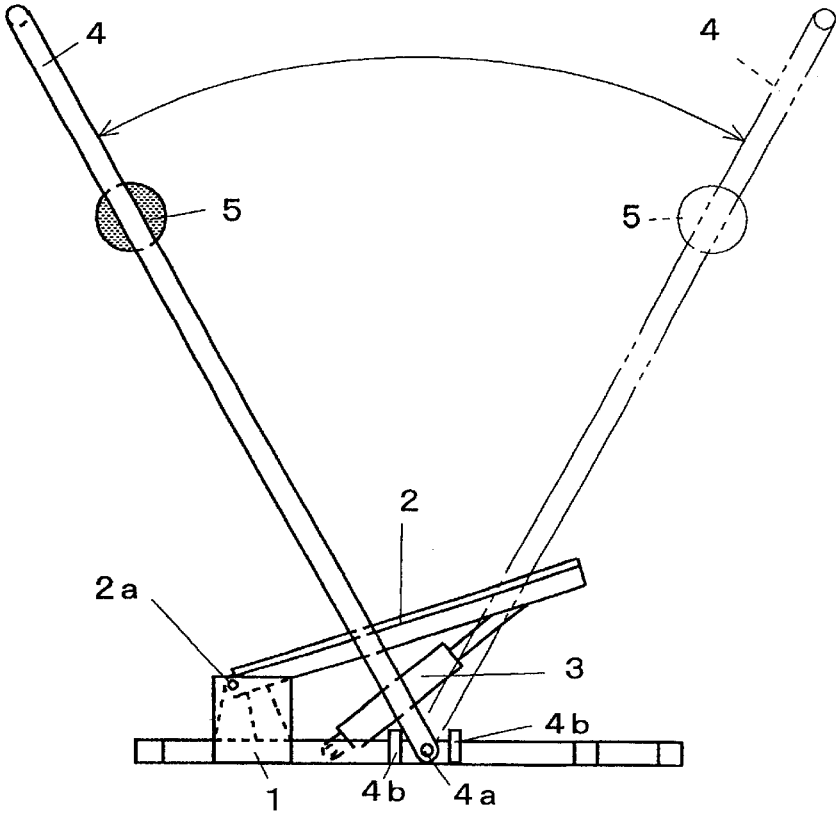
FIG. 1B is an explanatory view of the function thereof.

In FIG. 1A and FIG. 1B, there is shown a base 1, to which a pair of right and left foot platforms are secured by way of a shaft 2*a* such that said foot platforms are to be stepped there onto alternately to make vertically reciprocating swing motions. Said foot platforms 2 are supported by cylinders 3 which provide a load resistance. Further, said base 1 is attached with a hand support 4 by means of a shaft 4*a*. As clearly understood from FIG. 1B, said hand support 4 is adapted to be selectively inclined forwardly or rearwardly of the foot platforms to be locked thereat. In this way, said support is adapted to reverse an orientation with respect to said foot platform between positions forwardly of and rearwardly of said foot platforms. The orientation of said hand support 4 is limited by stoppers 4*b*. Said hand support 4 is provided with a back rest 5 at a height of the user's low back while the upper part of the hand support 4 may be used as a hand grip.

Figure 2A:
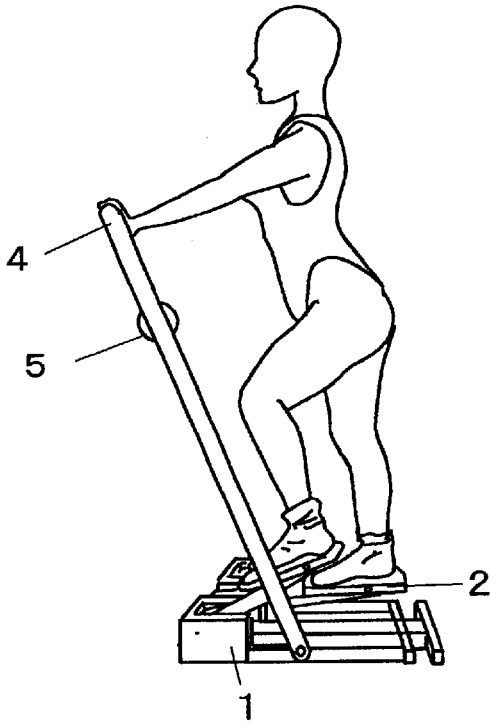
FIGS. 2A, 2B, 2C and 2D show various modes of use of the fitness machine of the invention.
Figure 2B:
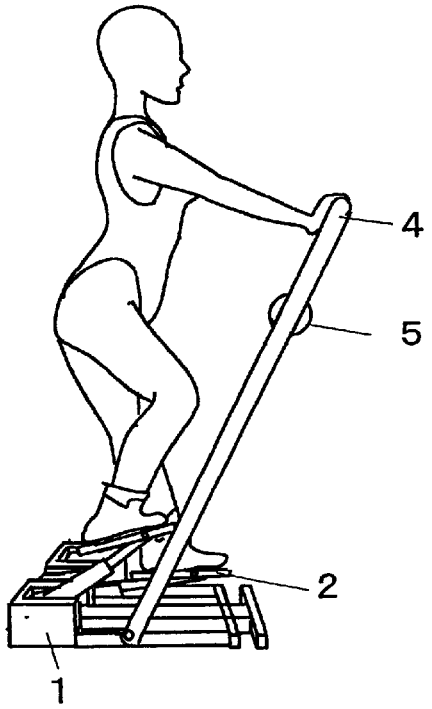
Figure 2C:
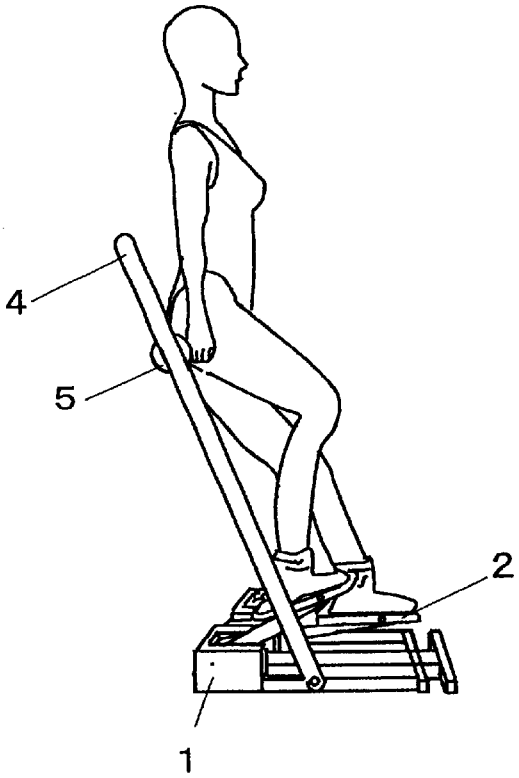
Figure 2D:
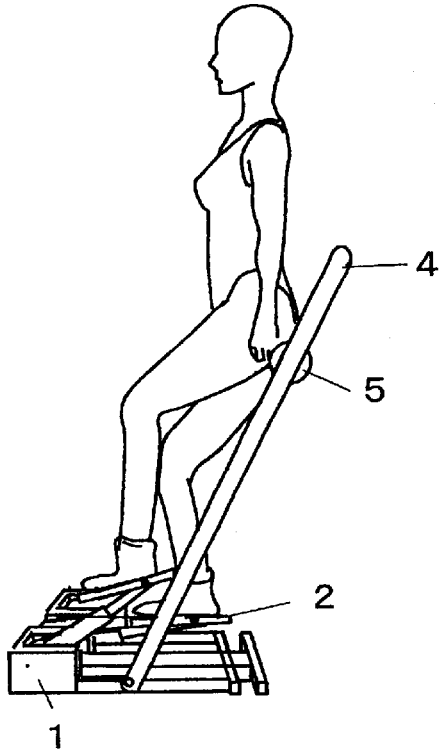

Since the fitness machine of the present invention is thus constructed as explained in the foregoing, it permits not only the ordinary use thereof such as stepping onto the foot platforms 2 with the user's weight being concentrated on his or her heels but also different mode of use such as reversing the orientation of the hand support 4 and then stepping onto the foot platforms 2 with the user's weight concentrated on his or her toes while gripping the upper portion of said hand support 4 to stabilize his or her balance, thus allowing the stretching of the Achilles tendons as well as the strengthening motion of stepping onto his or her toes. Further, as shown in FIG. 2C, the user may rest his or her low back against the back rest or seat 5 to support his or her body stable while toeing the foot platform 2 for the stepping exercise. On the other hand, the orientation of the hand support 4 may be reversed such that the user may rest his or her low back against the back rest while pressing his or her heel against said foot platform downward as shown in FIG. 2D.

Figure 3A:
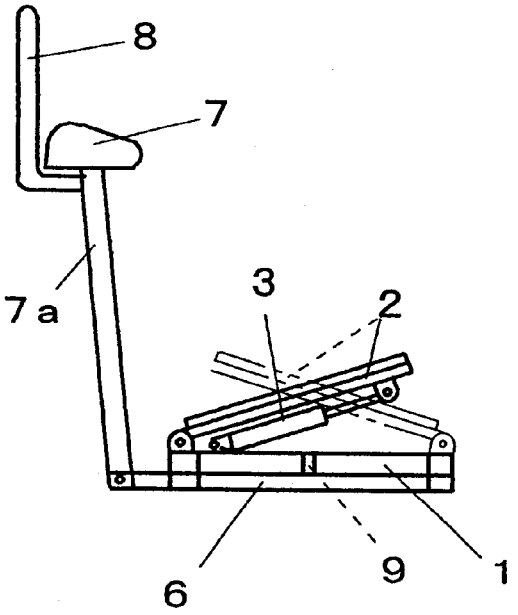
FIG. 3A is a front view of another embodiment of the invention.
Figure 3B:
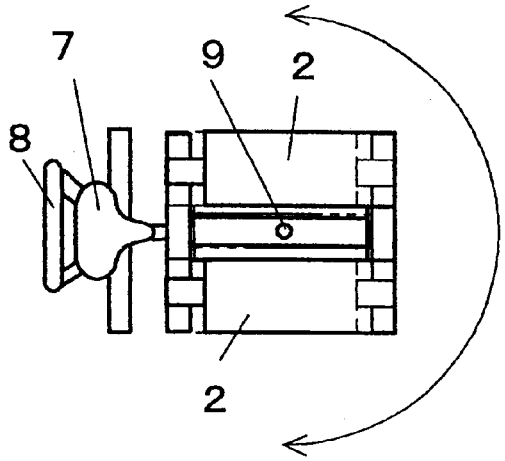
FIG. 3B is a plan view thereof.

FIG. 3A and FIG. 3B shows another embodiment of the present invention, in which a base 6 has a seat 7 attached thereto on one side thereof by way of a pole 7*a*. Said base 6 also has a plate 1 attached thereto by way of pivot 9 such that said plate 1 is adapted to turn about said pivot 9 as shown in the arrow-marked directions and to be secured by suitable lock means as shown real and phantom lines. Said pole 7*a* has a hand support 8 secured thereto. Needless to say, there are also provided foot platforms 2 and cylinders 3 as in the foregoing embodiment.

With the structure of this embodiment, the plate 1 is turned the other way around relative to the base 6, the seat 7 and the hand rest 8 such that the various modes of exercises as shown in FIG. 2A through 2D are done.

Figure 4A:
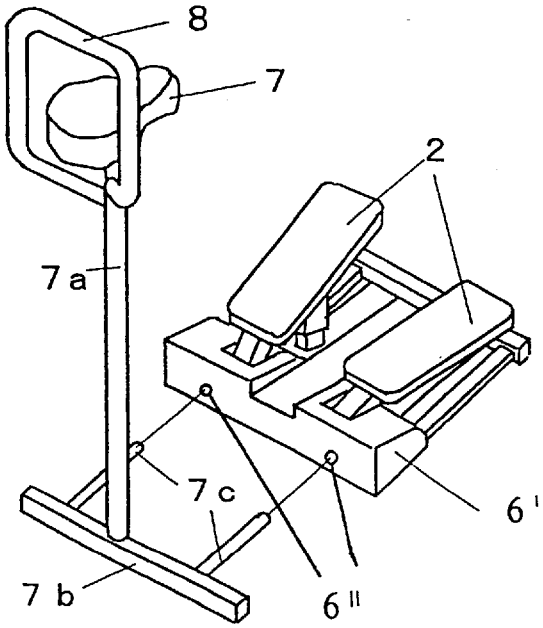
FIG. 4A is a perspective view of a further embodiment of the invention.
Figure 4B:
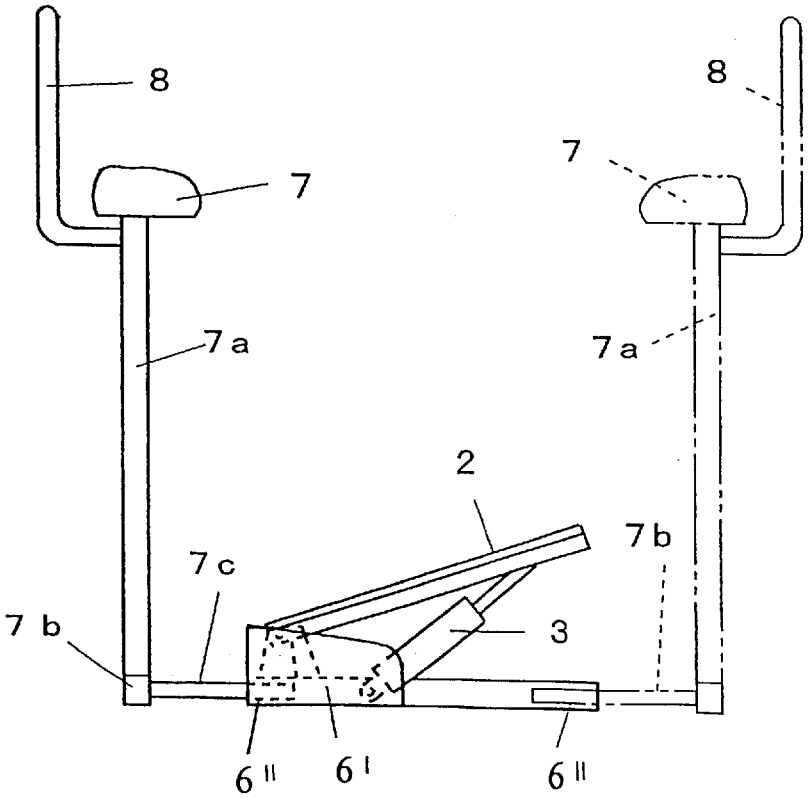
FIG. 4B is an explanatory view of the function thereof.

FIG. 4A and FIG. 4B shows a further embodiment of the invention, which is a modification of the previous embodiment. More specifically, the pole 7*a* is erected on a lateral beam 7*b* which is provided with inserts 7*c* inserted thereinto on both sides of the pole 7*a*. On the other hand, base 6' has holes 6" at a forward end and a rearward end adapted to selectively receive the free ends of said inserts 7*c*. This embodiment is also provided with foot platforms 2 on the base 6' and a seat 7 and a hand support 8 on the pole 7*a*. Therefore, this embodiment also allows the same mode of exercise as the two foregoing embodiments.

Figure 5A:
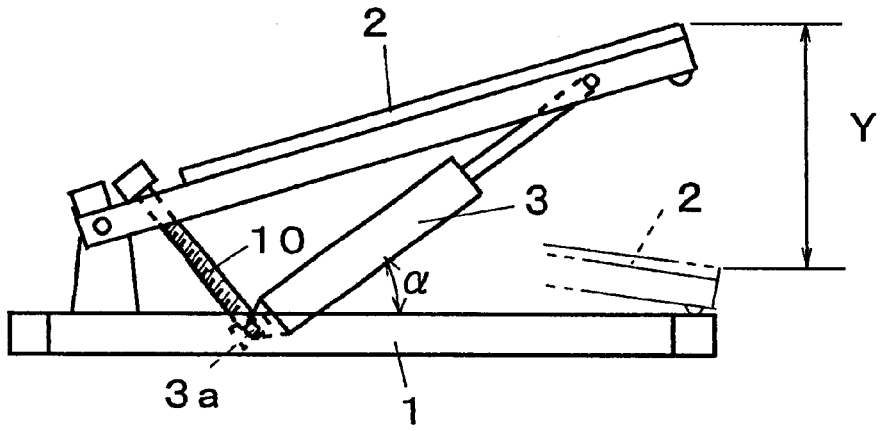
FIGS. 5A and 5B are explanatory views of the function of a still further embodiment of the invention.
Figure 5B:
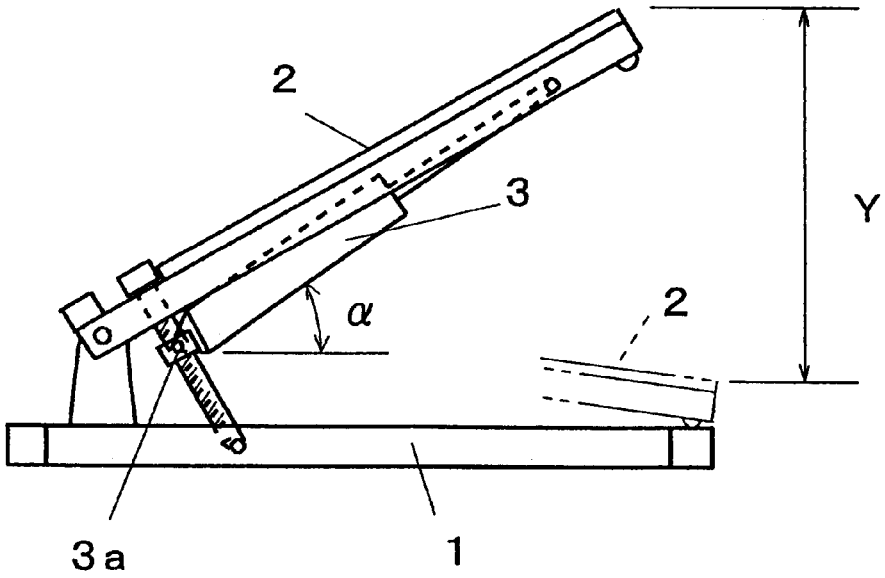

FIGS. 5A and 5B show a modified portion of a still further embodiment, in which the foot platforms 2 are supported by cylinders 3 which in turn are supported by fulcrums 3*a* on a base side thereof. Said fulcrums 3*a* are adapted to shift on a shaft 10 such that a substantial change in the stepping stroke Y of the foot platforms 2 will not involve an increase of the feel of the load because the angle $\alpha$ of the cylinders 3 kept unchanged to provide a constant load resistance.

Figure 6:
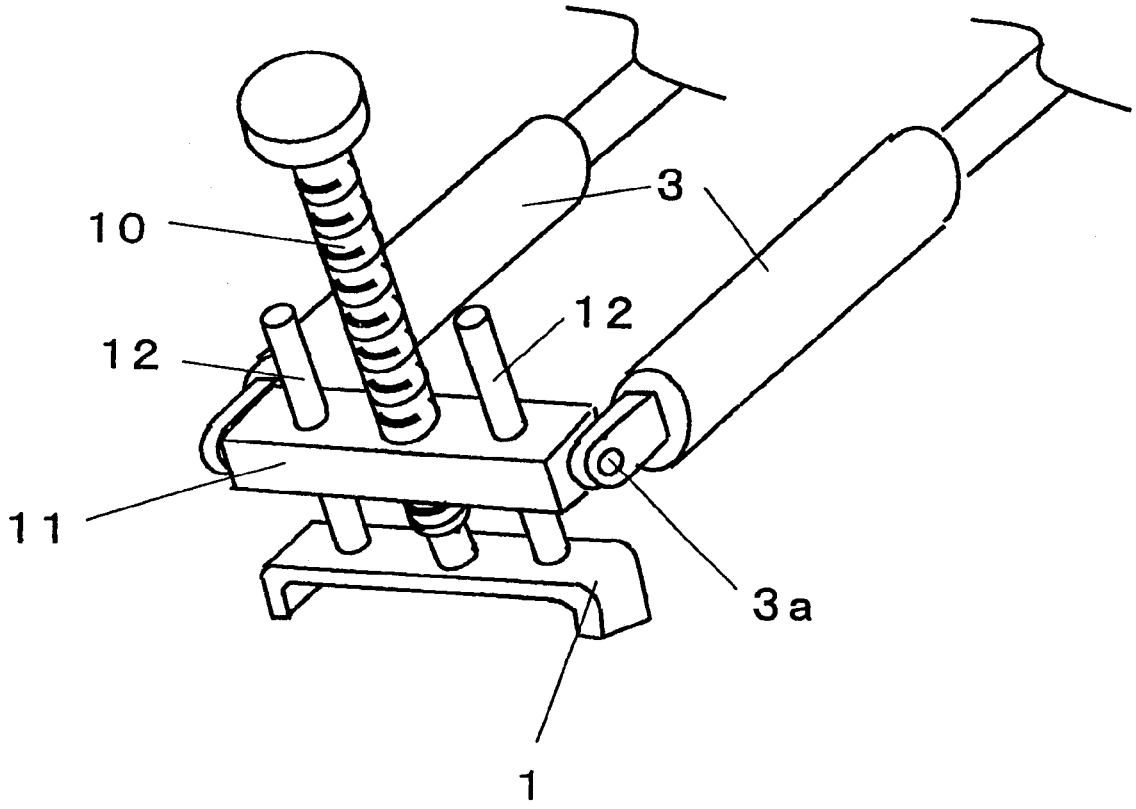
FIG. 6 is a perspective view of the primary portion of the embodiment shown in FIGS. 5A and 5B.

More specifically, the shifting structure of the fulcrum of the cylinders 3 is shown in FIG. 6, in which said shaft 10 is threaded and is made rotatable such that a shifting member 11 which is tapped to be screwed on said shaft 10 is shifted thereon by rotating said shaft 10. As a result, the fulcrums 3*a* pivoted on opposite ends of said shifting member 11 are reciprocated. In this operation, said shifting member 11 is guided by guide pins 12. In this way, said platforms are capable of changing a stepping stroke with a constant load resistance.

Figure 7:
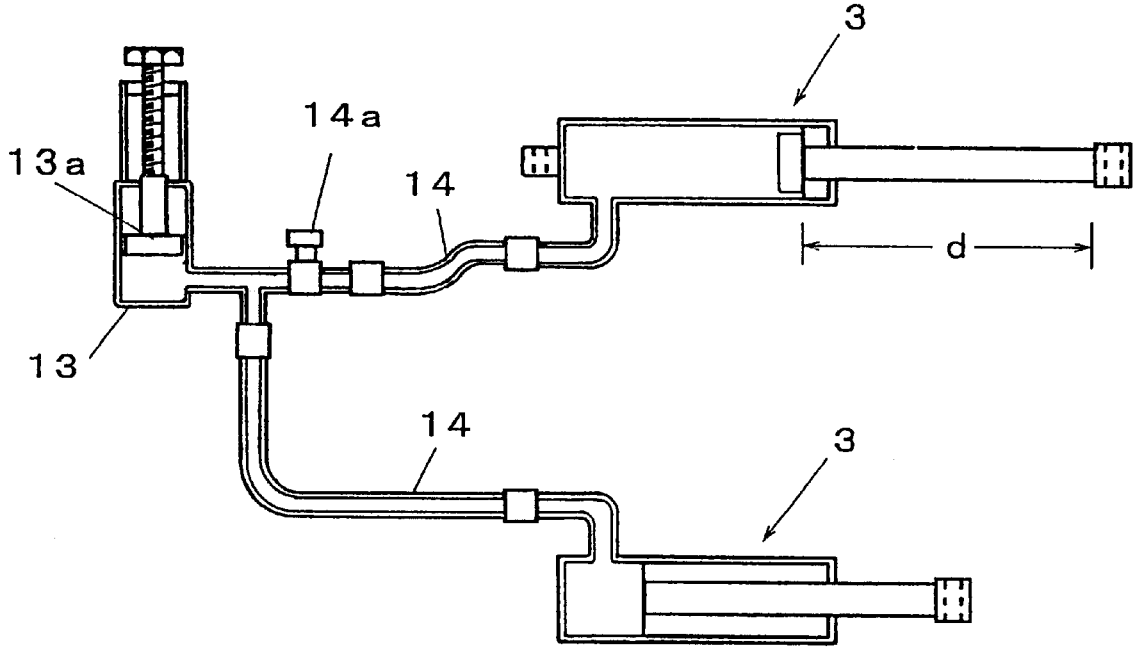
FIG. 7 is an explanatory view of the hydraulic system used in the embodiment of FIG. 5.

In order to adjust the load resistance imparted on said foot platforms 2 and the stepping stroke Y thereof by use of an actuating fluid, a circuit as shown in FIG. 7 is in need. In FIG. 7, there is shown a control chamber 13 which is connected to the cylinders 3 by way of connecting hoses 14. The capacity of side control chambers 13 are made variable by means of pistons 13*a*. More specifically, if the piston 13*a* is descended, the strike d is caused to be increased because the volume of the actuating fluid flowing into the cylinders 3 is increased, thus making the stepping stroke longer. At this time, the force required to press the cylinder 3 is made weaker if the restriction valve is loosened. On the other hand, if the piston 13*a* is raised, the volume of the actuating fluid flowing into the cylinders 13 is increased while the volume of the actuating fluid left in the cylinders 3 are reduced with the result that the stroke d of the cylinders 3 is made shorter, and in this way, the stepping stroke Y of the foot platforms 2 is adjusted. At this time, the force required to press the cylinder 3 is made stronger is the restrictive valve is tightened. In this connection, the foot platforms 2 are set at an angle of 40 degrees or thereabout, where the machine is used by the user taking a sitting posture as shown in FIGS. 2C and 2D, the same workout effects as the pedaling action obtains. In this way, the cylinders provide each platform with variable stepping stroke while maintaining a constant load resistance.

Figure 8A:
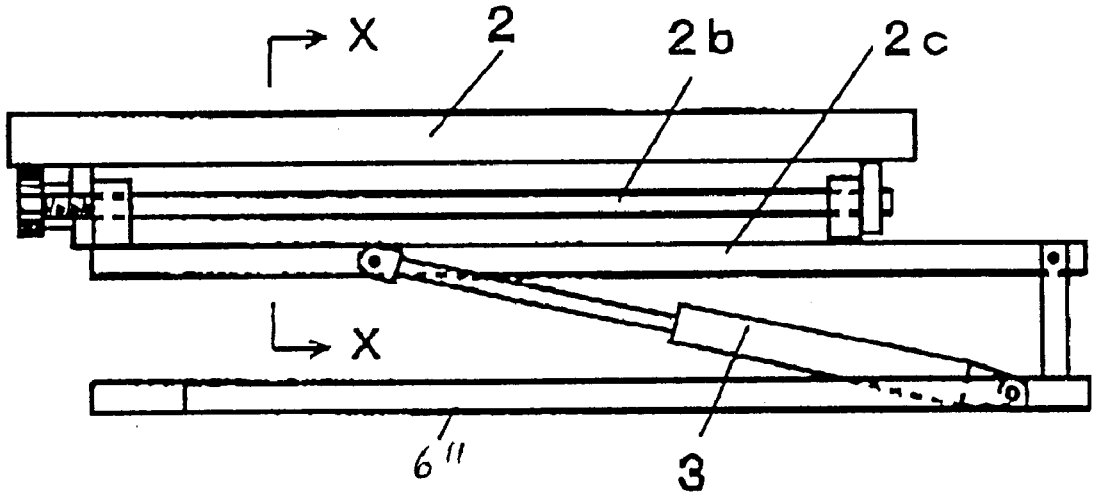
FIG. 8A is a primary portion of a still further embodiment of the invention and FIG. 8B is a cross sectional view of the function thereof, taken along the line X—X.
Figure 8B:
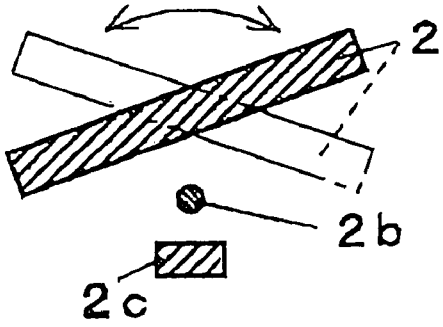
Figure 9:
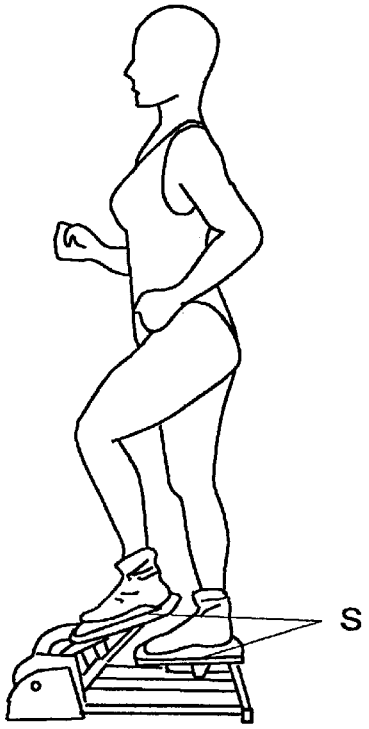
Fig. 9 PRIOR ART
FIG. 9 is an explanatory view of one example of the conventional fitness machine.
Figure 10:
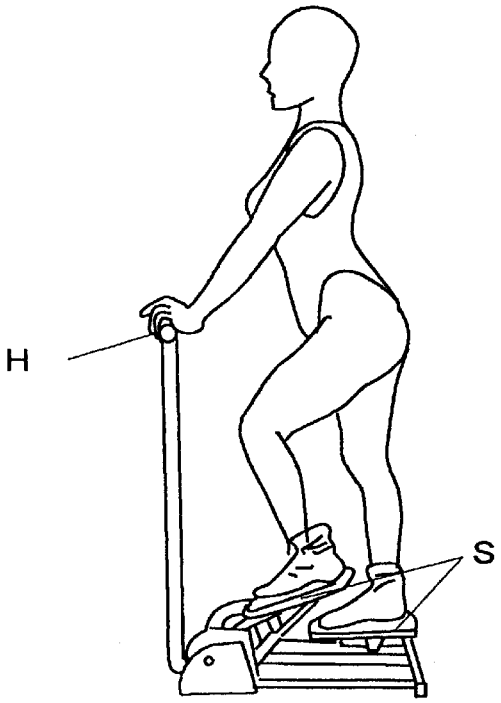
Fig. 10 PRIOR ART
FIG. 10 is an explanatory view of another example of the conventional fitness machine.
Figure 11A:
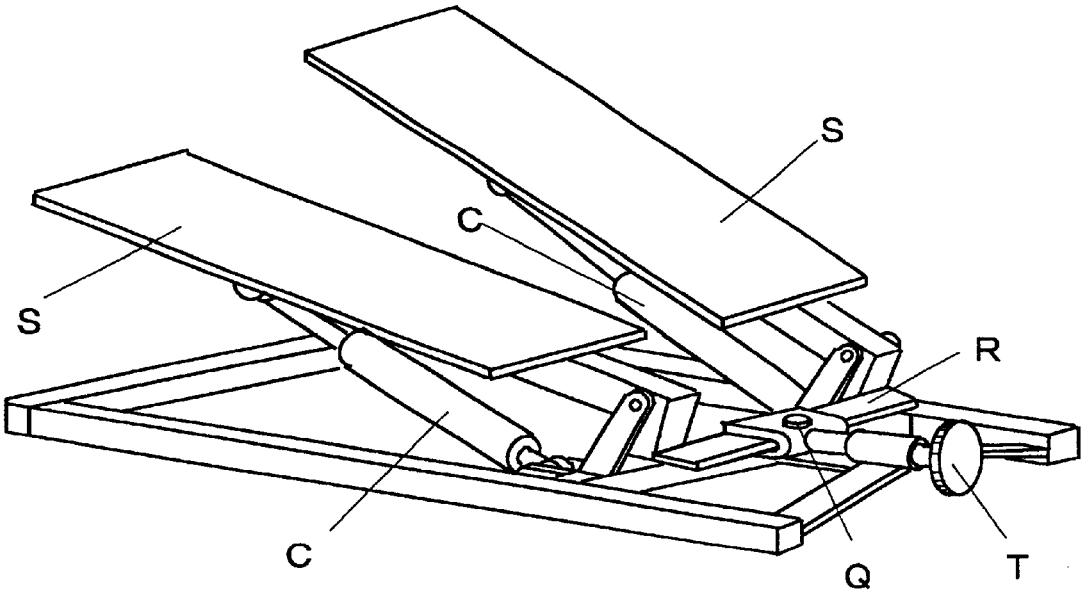
Fig. 11A PRIOR ART
FIG. 11A and FIG. 11B are explanatory views of a further example of the conventional fitness machine.
Figure 11B:
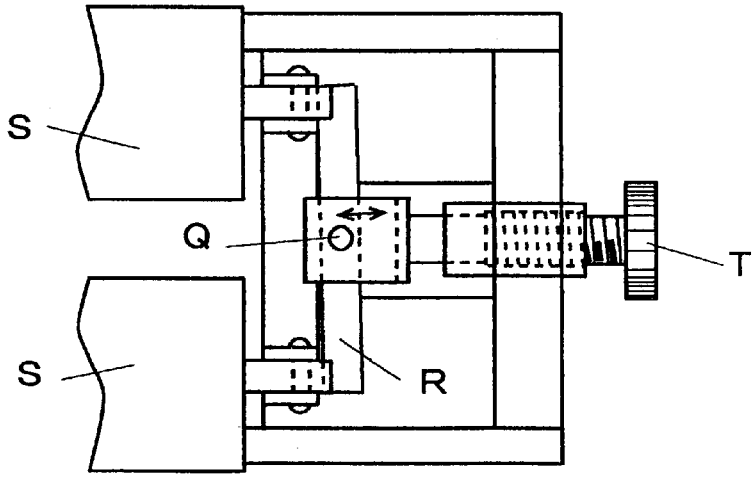
Fig. 11B PRIOR ART
Figure 12A:
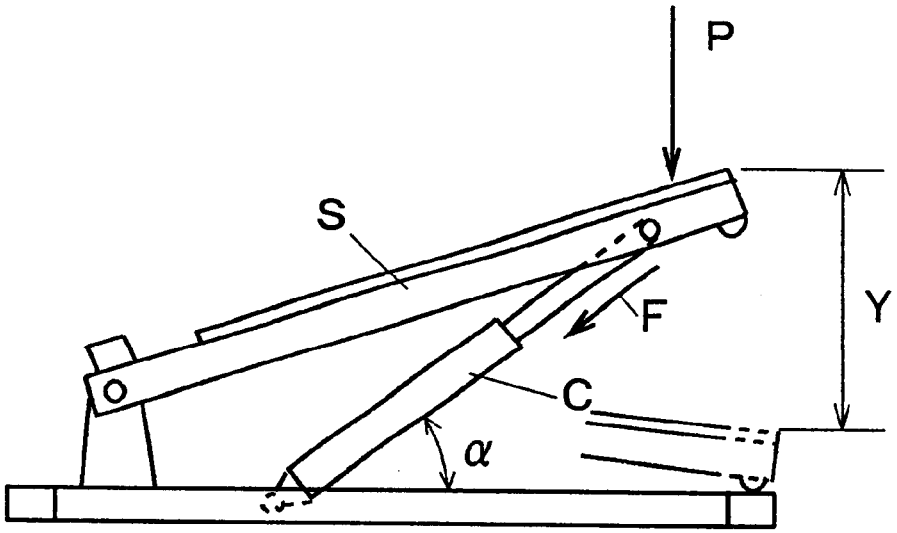
Fig. 12A PRIOR ART
FIG. 12A and FIG. 12B are explanatory views of a still further example of the conventional fitness machine.
Figure 12B:
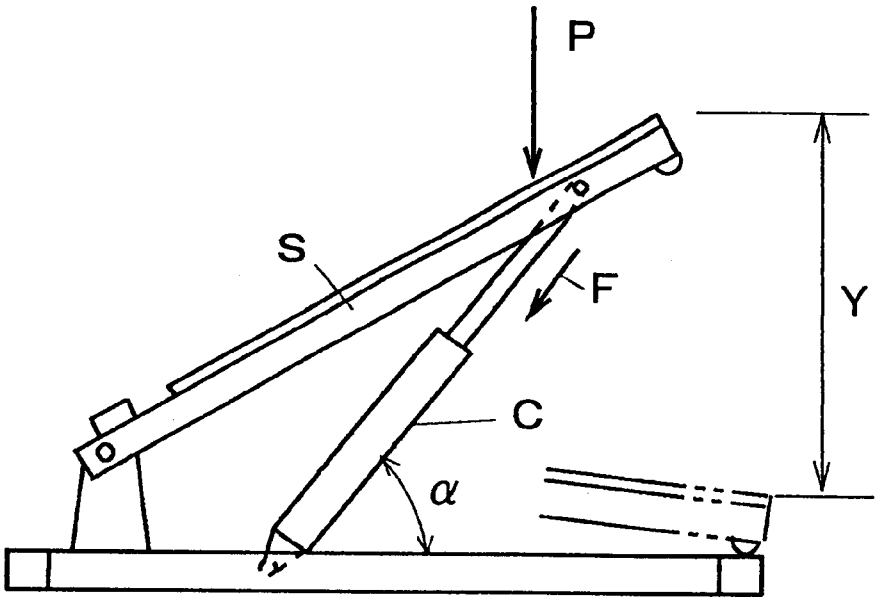
Fig. 12B PRIOR ART

FIG. 8A shows a modified portion of a still further embodiment in which said foot platforms 2 are pivoted on the base 6' by way of shafts 2*b* and stepping members 2*c* such that the foot platforms 2 may be set at laterally inclined positions as shown in FIG. 8B. With this structure, if the right and left foot platforms 2 are used as mutually inclined inwardly, the stepping action thereon will cure the bow leg. On the other hand, if the right and left foot platforms are used as mutually inclined outwardly, the stepping action thereon will cure the pigeon-toed leg.

With the structure in which the grip portion of the hand support and the seat are designed to reverse orientations to both sides of the foot platforms, such workout effects unexpected with the conventional machines are obtained in addition to the normal stepping workout effects such as toeing exercises, stretching of the Achilles tendons, pedaling actions or the like.

My making movable the fulcrum of the cylinders under the foot platforms, a large stepping stroke is obtained with a reduced load resistance, thus giving efficient pedaling exercise.

With the right hand left cylinders supporting the foot platforms being connected by a circuit wherein a chamber and a valve to control the volume and resistance of the actuating fluid are provided, a large stepping stroke is obtained while giving an efficient pedaling exercise is done.

By making it possible to set the foot platforms to take laterally inclined positions outwardly and inwardly, the bow leg or the pigeon leg can be cured.

What is claimed is:

1. A fitness machine for a stepping exercise comprising:

a base;

a stepper device pivotally secured to said base for alternately making vertically reciprocating motions relative to said base;

a pole engaged to the base at a first end thereof, the pole having a hand grip at a second end thereof and a body support (5,7) between the hand grip and the first end of the pole;

means on the base for reversing orientation of the pole with respect to said stepper device so that the hand grip and the body support (5,7) are both together laterally spaced apart opposite from either end of opposite ends of the stepper device.

2. The fitness machine according to claim 1, wherein the means for reversing orientation of the pole with respect to the stepper device is a pivot on the base to which the first end of the pole is rotatably engaged.

3. The fitness machine according to claim 2, wherein stoppers are respectively located on the base at opposite sides of the pivot to first rotation of the pole around the pivot.

4. The fitness machine according to claim 1, wherein the means for reversing orientation of the pole with respect to the stepper device is a pivot on the base to which the stepper device is rotatably engaged to permit either end of the opposite ends of the stepper device to be arranged opposite the pole.

5. The fitness machine according to claim 1, wherein the means for reversing orientation of the pole with respect to the stepper device are insets located at the first end of the pole which are selectively engaged to holes on either end of opposite ends of the base.

6. The fitness machine according to claim 2, wherein the body support is a back rest.

7. The fitness machine according to claim 4, wherein the body support is a seat.

8. The fitness machine according to claim 5, wherein the body support is a seat.

* * * * *